United States Patent [19]

Price et al.

[11] Patent Number: 4,924,546

[45] Date of Patent: May 15, 1990

[54] METHOD OF AND APPARATUS FOR PULLING OVER AND LASTING FOOTWEAR

[75] Inventors: Frank C. Price, Leicester; Gerhard Giebel, Bad Soden; Rudi Fichtner, Rossbach; Manfred Broening, Frankfurt, all of Fed. Rep. of Germany

[73] Assignee: DVSG Patentverwaltungs GmbH, Frankfurt am Main, Fed. Rep. of Germany

[21] Appl. No.: 247,108

[22] Filed: Sep. 20, 1988

[30] Foreign Application Priority Data

Sep. 24, 1987 [DE] Fed. Rep. of Germany ..... 3732224

[51] Int. Cl.[5] ..... A43D 7/00; A43D 29/00

[52] U.S. Cl. ..... 12/7.1; 12/145; 12/54.3; 12/7

[58] Field of Search ..... 12/1 A, 10, 10.1, 12.2, 12/12.4, 54.1, 54.2, 54.3, 54.4, 52.5, 145, 7, 7.1

[56] References Cited

U.S. PATENT DOCUMENTS

| | | | |
|---|---|---|---|
| 3,591,880 | 7/1971 | Muhlbach et al. | 12/7.1 |
| 3,906,569 | 9/1975 | Garner et al. | 12/10.1 |
| 4,338,696 | 7/1982 | Bichet | 12/54.3 |
| 4,530,124 | 7/1985 | Sommer | 12/12.2 |
| 4,653,133 | 3/1987 | Giebel | 12/12.2 |
| 4,660,242 | 4/1987 | Vornberger et al. | 12/54.1 |
| 4,688,288 | 8/1987 | Gebel et al. | 12/12.2 |
| 4,709,433 | 12/1987 | Walega | 12/54.3 |

FOREIGN PATENT DOCUMENTS

| | | |
|---|---|---|
| 1917448 | 2/1972 | Fed. Rep. of Germany . |
| 1277301 | 6/1972 | United Kingdom . |

*Primary Examiner*—Steven N. Meyers

[57] ABSTRACT

The pulling over assembly (2, 39) and lasting assembly (13, 40) of a pulling over and lasting machine are capable of being moved apart to enable a pulling over operation to be effected on one shoe at a first station (I) while a lasting operation is being completed on a further shoe at a second station (II). In one embodiment the pulling over assembly (2) moves bodily to the second station (II) at which the lasting assembly (13) is arranged; in a second embodiment the lasting assembly (40) moves to the first station (I) at which the pulling over assembly (39) is arranged. Each assembly (2, 13; 39, 40) has a heel rest (5, 19; 41, 50), the heel rests being so arranged as to carry out without collision the function of holding the shoe against lengthwise displacement.

13 Claims, 10 Drawing Sheets

METHOD OF AND APPARATUS FOR PULLING OVER AND LASTING FOOTWEAR

BACKGROUND OF THE INVENTION

This invention is concerned with a method of pulling over and lasting footwear mounted on a last, wherein a pulling over assembly and a lasting assembly can be positioned by relative movement therebetweeen at two separate stations, the pulling over process taking place at the first station and the lasting operation being completed at the second station.

Such a method is known from DE-C 1917448, in carrying out which method there are two operating localities each having two stations. Each operating locality comprises its own lasting assembly, while for both operating localities a common pulling over assembly is provided which is moved to-and-fro between the two operating localities. The method takes place essentially in such a manner that a shoe to be operated upon is inserted at the first station of the one operating locality, whereat the pulling over assembly and the lasting assembly are disposed, whereupon by means of the pulling over assembly the pulling over operation takes place, associated with which is an activity of the lasting assembly whereby the upper of the shoe is merely wiped over on to the last, resulting in the shoe being taken over by the lasting assembly. In this way the pulling over assembly can release the upper. The pulling over assembly is then moved to the adjacent further operating locality, in which it is used in the same manner as previously described. The lasting assembly, which, as indicated, had taken over the shoe within the first operating locality, is then moved to the second station of said operating locality, at which the lasting operation is completed. During this, the pulling over assembly can carry out its previously described operation at the adjacent operating locality in cooperation with the further lasting assembly. The first lasting assembly is finally moved, when the lasting operation is completed, back to the first station of the first operating locality, where in cooperation with the single pulling over assembly provided for both operating localities it effects the treatment of a new shoe in the above-described manner.

In carrying out this method therefore one pulling over assembly and two lasting assemblies are required, one lasting assembly being arranged at each of the two adjacent operating localities and the pulling over assembly being moved to-and-fro between these two operating localities. The machine which operates in accordance with this known method is therefore relatively expensive to build.

OBJECT OF THE INVENTION

The invention has for its object to reduce this expense.

SUMMARY OF THE INVENTION

In accordance with the invention this object is achieved in that, in a machine as set out in the first paraphraph above, when a shoe is inserted in the first station, the pulling over assembly is positioned at this station and the lasting assembly at the second station, and the pulling over operation is effected at the first station whereupon the pulling over assembly and lasting assembly are brought together for lasting, either at the first or the second station, then after the shoe has been received by the lasting assembly the pulling over assembly and the lasting assembly are once more moved away from one another and the lasting assembly alone completes the lasting operation at the second station, during which time the pulling over assembly is loaded at the first station with a further shoe.

In carrying out this method, therefore only one pulling over assembly and a single lasting assembly are required. By the movement relative to one another of the pulling over assembly and lasting assembly and by, as a result, rendering the pulling over assembly wholly accessible at the first station for the insertion of a shoe, the operator is provided with a great over-view and facility for correction in respect of the pulling over operation. Furthermore, because the lasting operation is completed at the second station the possibility arises of using the time necessary for this completion in order to insert and pull over a further shoe, since during this period the pulling over assembly is available for such insertion and pulling over, being free from the lasting assembly.

For carrying out the above method preferably there is provided an apparatus for pulling over and lasting shoes comprising a pulling over assembly arranged at a first station and comprising a shoe support for supporting a shoe comprising a shoe upper on a last with an insole on the last bottom, and an array of pincers arranged about the shoe support, whereby the upper of a shoe supported by the shoe support can be gripped by the pincers and, by relative movement being effected between the pincers and shoe support heightwise of the shoe bottom, can be tensioned about its last, and a lasting assembly arranged at a second station and comprising a pair of wiper plates by which lasting marginal portions of a shoe upper tensioned as aforesaid can be wiped over and pressed against corresponding marginal portions of the insole of such shoe, wherein means is provided for effecting relative movement of approach between the pulling over assembly and the lasting assembly to bring the assemblies into a cooperative relationship, in which a shoe upper tensioned as aforesaid is released by the pulling over assembly and control thereof is transferred to the lasting assembly without loss of tension in the upper, and for effecting relative movement of separation therebetween, whereby the lasting operation can be completed at the second station while a further pulling over operation can be initiated at the first station. Moreover, preferably in such an apparatus the pulling over assembly and the lasting assembly each comprises shoe retaining means for holding a shoe supported thereby against lengthwise displacement respectively in the pulling over and lasting operations whereby each assembly can perform its function independently of the other, and said means for effecting relative movement between the assemblies is effective to move them into said cooperative relationship only after a shoe upper has been tensioned as aforesaid by the pulling over assembly and a previously treated shoe has been released by the lasting assembly.

It will be appreciated that an apparatus could be provided wherein both the pulling over assembly and also the lasting assembly are movable, but preferably in accordance with the present invention one of the assemblies is fixed at its station and the other is movable between the stations. In one embodiment of the invention the pulling over assembly is mounted for movement between the first and second stations. Thus in the operation of this apparatus, following the pulling over operation the pulling over assembly together with the pulled-over shoe is moved to the second station at which the shoe, held by the pulling over assembly, is disposed opposite the lasting assembly, whereafter the shoe is lasted by the lasting assembly and, after the lasting margin has been taken over by the lasting assembly, the pulling over assembly is returned empty to the first station at which the pulling over assembly is loaded once more with a shoe, while at the second stage the lasting operation is completed and the lasted shoe ejected. It will be appreciated that, using this embodiment, the pulling over assembly can, after the shoe has been received at the second station by the lasting assembly, to be returned immediately to the first station where, during the period in which the lasting operation is completed at the second station, it can again effect a pulling over operation with a new shoe.

In this embodiment furthermore, conveniently the direction of movement of the pulling over assembly extends transversely of the shoe supported thereby.

In an alternative embodiment of the invention, the lasting assembly is mounted for movement between the first and second stations. In this case, moreover, conveniently the direction of movement of the lasting assembly extends lengthwise of the shoe supported thereby. In the operation of this embodiment, after the pulling over operation the lasting assembly is transferred from the second to the first station and the pulled-over shoe at the first station is wiped over or lasted by means of the lasting assembly, then the lasting assembly is moved together with the wiped-over or lasted shoe alone to the second station, whereupon the pulling over assembly remaining at the first station is loaded once more at the first station with a shoe, while at the second station the lasting operation is completed and the lasted shoe ejected. It will thus be appreciated that using this embodiment, after the shoe has been moved to the second station by the lasting assembly, the pulling over assembly is free for use and can carry out a further pulling over operation on a new shoe.

It will be appreciated that, if desired, using either embodiment further operating steps may be effected on the shoe prior to the completion of the inwiping movement of the wiper plates of the lasting assembly, e.g. a lining trimming operation. Furthermore, in addition to lasting the toe and forepart portions of the shoe, it would be possible in either embodiment to effect lasting over the ball and indeed, if desired, into the shank region of the shoe bottom, which of course extends the time necessary for completing the lasting operation. This of course renders the present invention even more effective in that the extended lasting time can be taken up by pulling over a new shoe for a subsequent lasting operation to be performed thereon.

As already mentioned above, each of the two assemblies comprises shoe retaining means by which the shoe can be held against movement in a direction extending lengthwise thereof as the upper is pulled over its last in the pulling over operation and also as the lasting marginal portions of the upper are wiped under the insole edge in the lasting operation. In order to transfer the control of the shoe satisfactorily, it is desirable that, during the change-over stage, the two individual shoe retaining means can both engage the shoe without collision, and to this end in accordance with the present invention preferably the shoe retaining means of one of said assemblies is constituted by a shoe clamp arrangement by which the shoe can be clamped by engagement at opposite sides thereof adjacent the heel end and the shoe retaining means of the other of said assemblies is constituted by a heel rest in the form of a pad by which the backseam region of the shoe is engaged.

Again as already mentioned, for supporting the shoe during the pulling over operation a shoe support is provided forming part of the pulling over assembly. In order better to control the lasting operation, furthermore, preferably the lasting assembly also comprises a shoe support for supporting the shoe at the lasting station. In addition, the lasting assembly further conveniently comprises, as is customary in pulling over and lasting machines, a toe pad by which a shoe which has been operated upon at the pulling over station is engaged when the assemblies are moved to their cooperative relationship. It will thus be appreciated that, as the control of the shoe passes to the lasting assembly, the shoe is held between the toe pad and the wiper plates and also the shoe support forming part of the lasting assembly.

In the operation of either of the two embodiments, conveniently while the two assemblies are in their cooperative relationship the wiper plates are caused to move inwardly to an intermediate position in which leading edge portions thereof have just traversed the insole edge whereby the lasting marginal portions of the upper are trapped against the insole, the pincers of the pulling over assembly releasing the upper in timed relation with such movement of the wiper plates, and relative movement of separation thereafter taking place between the assemblies while the wiper plates are retained in this condition. In this way, the lasting margin control is transferred from the pulling over assembly to the lasting assembly, in a manner which is generally as in conventional pulling over and toe lasting machines, except that in this case relative movement of separation can then take place between the assembly to leave the pulling over assembly free for pulling over a new shoe while the lasting operation is completed.

With the wiper plate in this intermediate position, it is of course then possible, as is also conventional, for adhesive to be applied to marginal portions of the insole of the shoe prior to the completion of the inwiping movement of the wiper plates. To this end, either the pulling over assembly or the lasting assembly may comprise adhesive-applying means, e.g. an imprinter plate, but preferably in accordance with the invention it is the lasting station which has adhesive-applying means associated therewith. In this way, once the lasting margin control has been transferred to the lasting assembly and the lasting assembly, at the second station, is separated from the pulling over assembly, the adhesive-applying operation can be effected followed by completion of the inwiping movement of the wiper plates. The adhesive-applying means may be constituted by a conventional so-called imprinter plate; alternatively, however, in accordance with the invention conveniently the adhesive-applying means comprises two nozzles and means for moving the nozzles along opposite sides of the shoe progressively in a direction from the toe end heelwardly.

BRIEF DESCRIPTION OF THE DRAWINGS

There now follows a detailed description, to be read with reference to the accompanying drawings, of two apparatuses in accordance with the invention. It will of course be appreciated that these two apparatuses have been selected for description merely by way of non-limiting example of the invention.

In the accompanying drawings:

FIG. 1—the apparatus with a shoe inserted in the pulling over assembly at the first station;

FIG. 2—the same apparatus with the pulling over assembly moved to the second station together with the pulled-over shoe;

FIG. 3—the same apparatus with the shoe taken over at the second station by the lasting assembly and the pulling over assembly returned to the first station;

FIG. 4—the same apparatus with the shoe disposed at the second station, on which shoe the lasting operation is completed, and a new shoe inserted in the first station;

FIG. 7—the apparatus with a shoe inserted in the pulling over assembly at the first station;

FIG. 8—the same apparatus with the shoe wiped over at the first station;

FIG. 9—the same apparatus with the shoe held by the lasting assembly at the second station; and FIG. 10—the same apparatus with the shoe disposed at the second station, on which shoe the lasting operation is completed, and a new shoe inserted at the first station.

DESCRIPTION OF THE PREFERRED EMBODIMENTS

Figure 1:
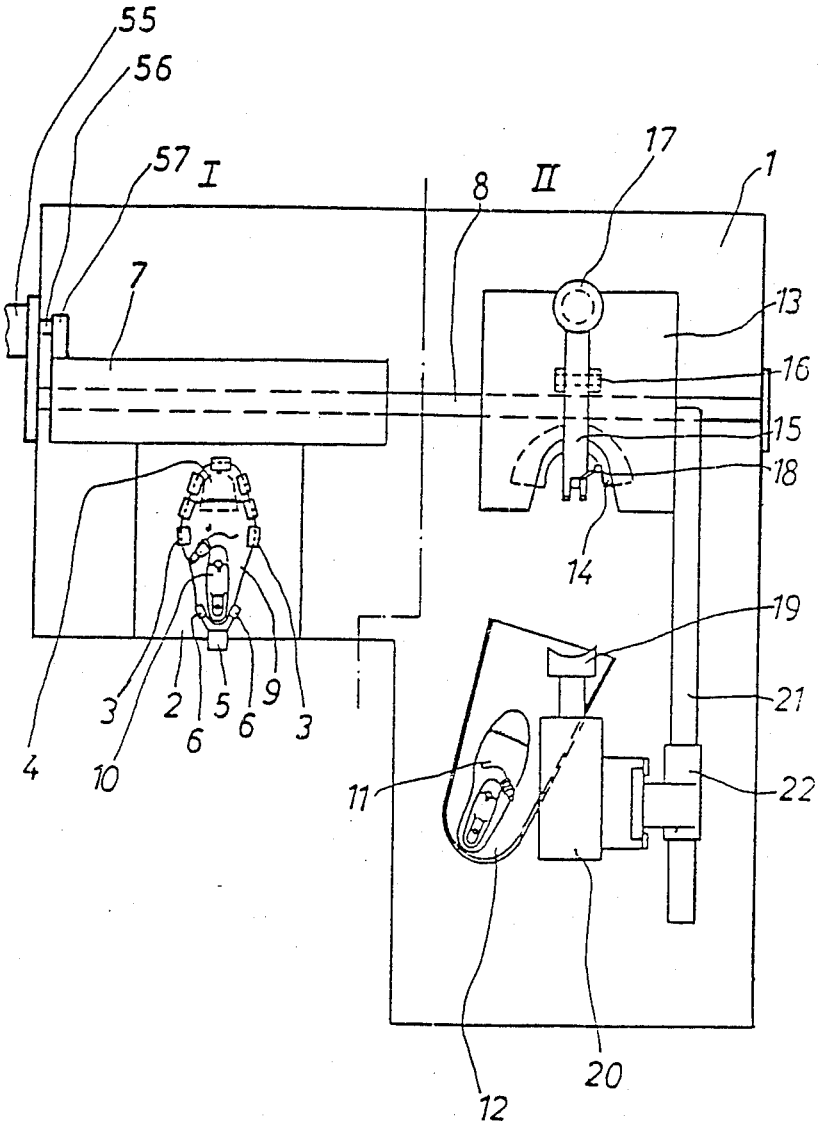
FIGS. 1 to 4 show in plan view and FIGS. 5 and 6 in side view a first apparatus in accordance with the invention wherein a pulling over assembly thereof is mounted for movement between a first and second station and a lasting assembly thereof is fixedly mounted at a second station, the individual Figures showing in detail the following.

The apparatus shown in FIGS. 1 to 6 comprises a frame 1 on which, shown by a chain-dot line of separation, a first station designated I and a second station designated II are arranged. In the operating phase shown in FIG. 1, there is disposed at the first station I a pulling over assembly 2 of which essential known component parts are illustrated, namely pincers 3 and a last support 4. Furthermore, forming part of the pulling over assembly 2 is also a heel rest 5 comprising two arms 6 which embrace the heel end of the upper 9 of a shoe inserted into the pulling over assembly 2 together with its last 10 having an insole 25 on the bottom thereof. The pulling over assembly 2 is carried by a slide 7 which is mounted for movement on guide rails 8. As can be seen from FIG. 5 (to be referred to hereinafter) two such guide rails 8 are provided. By means of the slide 7 and the guide rails 8 the pulling over assembly 2 can be moved from the first station to the second station and back.

The shoe upper 9 is pulled over by the pulling over assembly 2 and thus prepared for the following lasting operation.

The second station II comprises a lasting assembly 13 comprising a wiper plate assembly 14 and a holddown 15 which is mounted for pivotal movement about an axis 16 by means of a cylinder 17; the latter may be actuated hydraulically or pneumatically. The holddown 15 includes a presser pad 54 (FIG. 5) clamped thereon by means of a clamp lever 18.

The second station further comprises a heel rest 19, which can be moved by means of a cylinder 20 in a direction lengthwise of a shoe to hold it in position against lengthwise displacement. For adjusting its setting, furthermore the heel rest 19 is mounted together with the cylinder 20, on a support 22 which is mounted for adjusting movement along a rail 21. The support 22 is lockable in adjusted position thus to lock the heel rest 19 and cylinder 20 against undesired displacement along the rail 21.

The second station also comprises a catcher tray 12 into which a shoe 11 is ejected at the end of the lasting operation.

Figure 2:
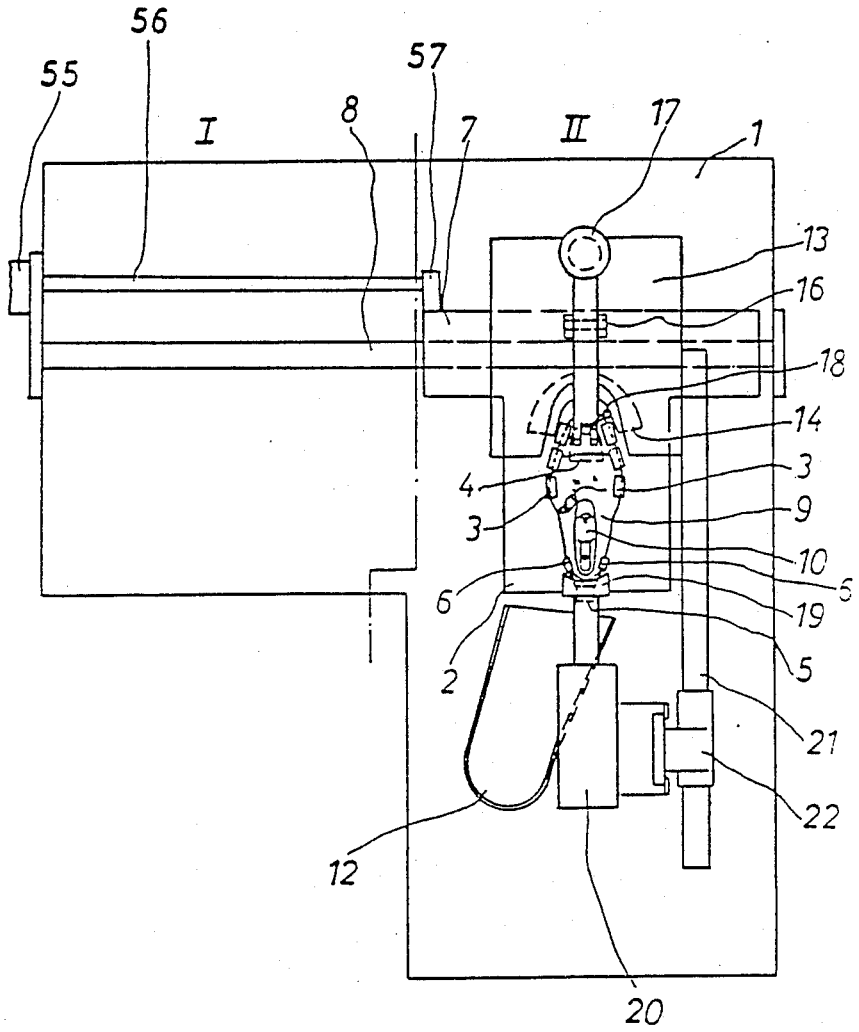

In the operating phase shown in FIG. 2 the pulling over assembly 2 together with the shoe upper 9 pulled over on the last 10 has been moved to the second station, this movement having been effected by a cylinder 55 a piston-rod 56, of which is connected to the slide via an arm 57. The pulling over assembly 2 and lasting assembly 13, initially positioned spaced apart from one another as shown in FIG. 1, are now positioned at the second station in opposed relationship with one another, as shown in FIG. 2. After such movement has been completed, the heel rest 19 of the lasting assembly is advanced until it engages with the heel end of the shoe upper 9, thus to hold the shoe upper 9 together with the last 10 secure for the following lasting operation. In order that the heel rest 19 can engage the heel end of the shoe prior to release of the latter by the heel rest 5 of the pulling over assembly 2, the heel rest 5, which comprises the two arms 6 for engaging the shoe at opposite sides thereof, spaced from the backseam region, is arranged to engage the shoe more closely to the feather line thereof, leaving the backseam region thus exposed for engagement by the heel rest 19 of the lasting assembly 13 when the shoe is moved as aforesaid to the second station II. The heel rest 5 is retracted only after the heel rest 19 is operative so that the shoe is always held against lengthwise displace-ment both in the pulling over operation and also during the inwiping movement of the wiper plate assembly 14.

During the shoe transfer movement of the pulling over assembly 2 the wiper plate assembly 14 is maintained in an open, inoperative, condition. When the pulling over and lasting assemblies 2, 13 are disposed in opposed relationship (as shown in FIG. 2) firstly the wiper plate assembly 14 is actuated to bring the wiper plates into an intermediate position in which leading edge portions of the plates have just traversed the insole margin, thereby causing the lasting marginal portions of the upper 9 to be trapped against the corresponding marginal portions of the insole 25. In this way the control of the shoe upper is transferred to the wiper plate assembly 14 from the pincers 3 of the pulling over assembly 2, which thus can now release their grip on the upper.

The pulling over assembly 2 can then, following release of the pincers 3 and retraction of the heel rest 5, return to the first station I, while the lasting operation is continued at the second station II. In carrying out the lasting operation, adhesive, e.g. a hot melt adhesive, may be applied to the insole margin while the wiper plate assembly 14 remains in its intermediate position. Thereafter the inwiping movement of the wiper plate assembly 14 is completed and bedding pressure is applied to consolidate the bond. This is the operating stage shown in FIG. 3.

It will be appreciated that, if desired, the inwiping movement of the wiper plate assembly may alternatively be completed prior to the return of the pulling over assembly 2 to the first station I.

Figure 3:
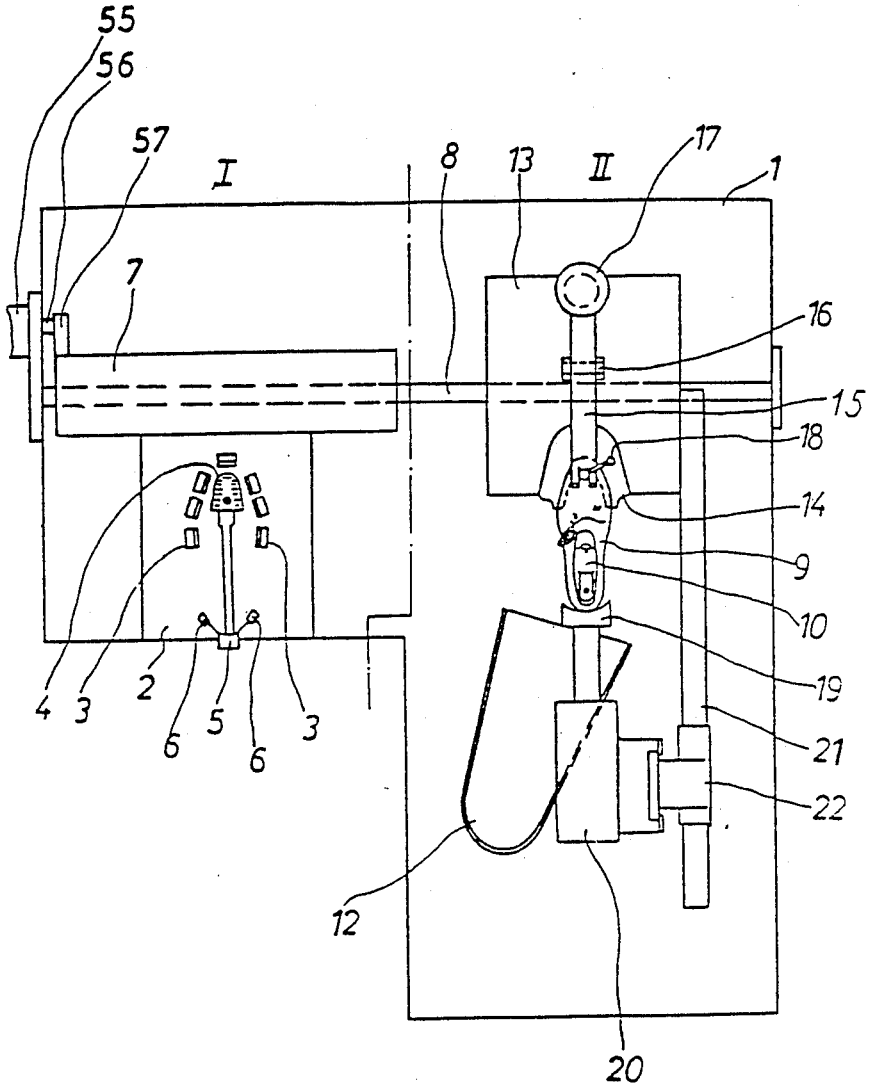
Figure 4:
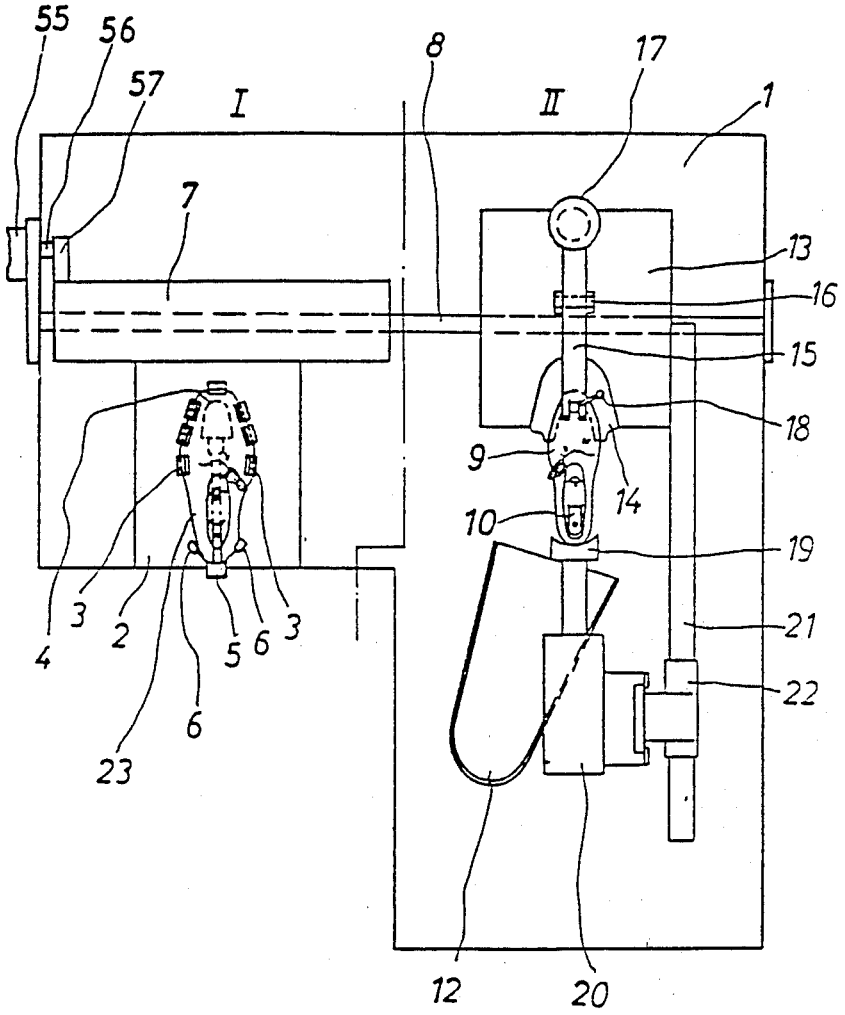

By reason of the separation of the lasting assembly 13 and pulling over assembly 2, it will be appreciated, the period during which the lasting operation takes place can be utilised for the insertion and pulling over of a new shoe. This operating stage is shown in FIG. 4. So far as concerns the positioning of the pulling over assembly 2 and lasting assembly 13 at the first and second stations, FIG. 4 corresponds completely with FIG. 3, but in FIG. 4 a new shoe 23 is shown inserted in the pulling over assembly 2. When the lasting operation on the shoe upper 9 at the second station is completed the shoe is ejected into the catcher tray 12. In this way the operating stage shown in FIG. 1 is reached whereupon the operating cycle can once more be initiated in the same manner, as previously described.

Figure 5:
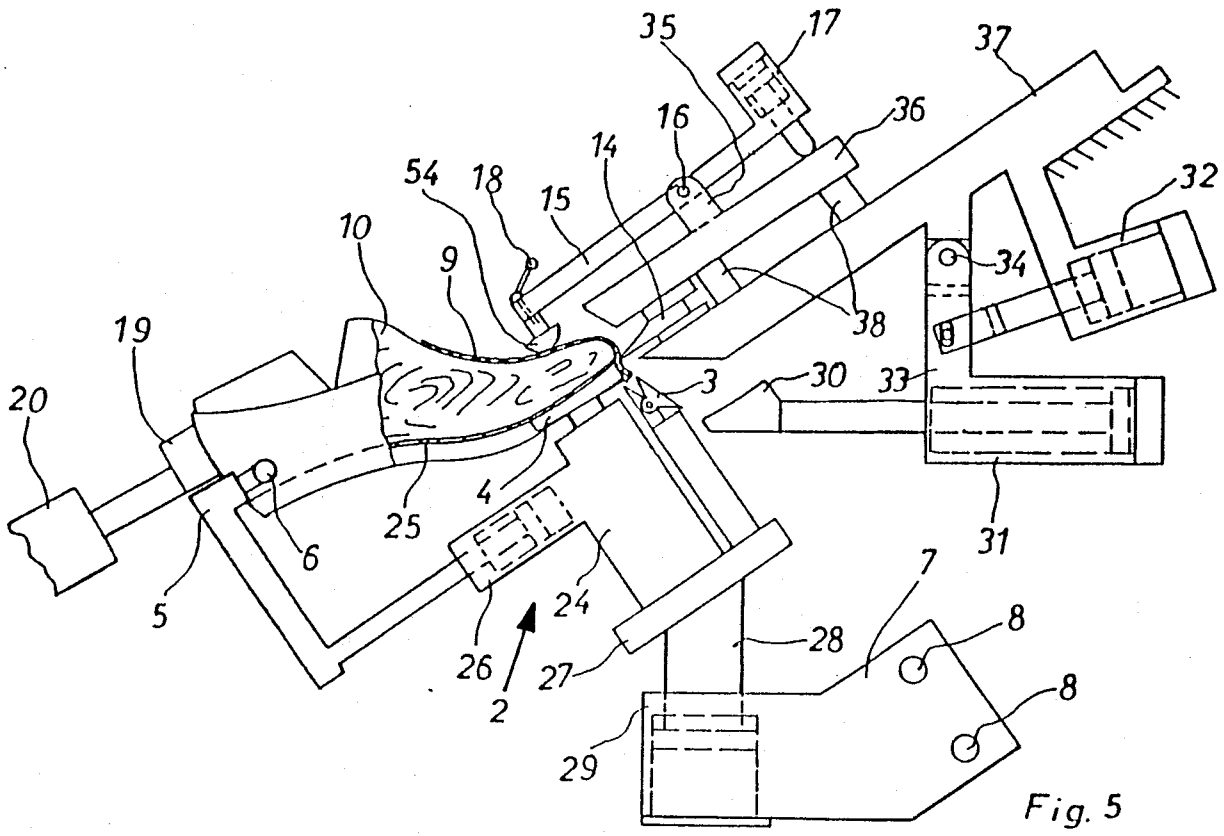
FIG. 5—the essential parts of the apparatus in accordance with FIGS. 1 to 4, having an upper wiped over at the second station, and the pulling over assembly in a position shortly before its return movement to the first station.
Figure 6:
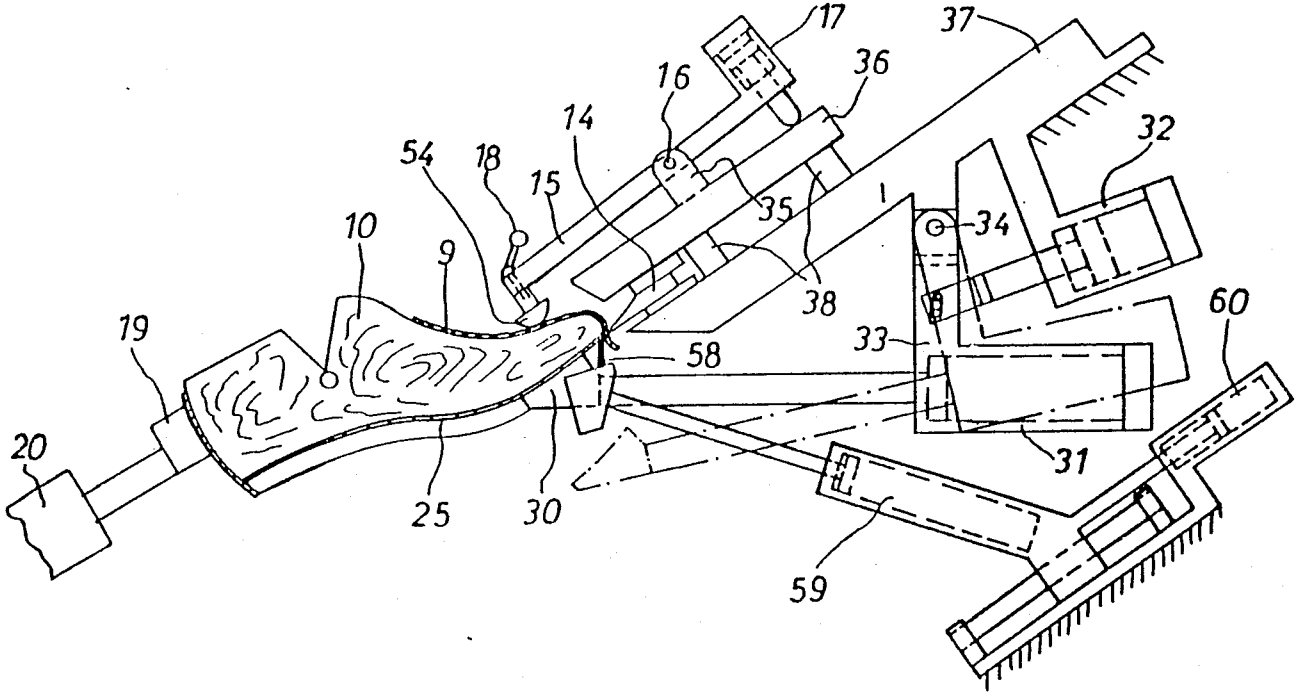
FIG. 6—essentially the same parts of the apparatus in accordance with FIG. 5 at the second station, but with the pulling over assembly withdrawn and with the lasting assembly immediately before completion of the lasting operation.

In FIGS. 5 and 6 are shown in side view essential parts of the apparatus shown in FIGS. 1 to 4. As shown in FIG. 5 the shoe upper 9 with its last 10 is disposed at the second station with the wiper plate assembly 14 in its intermediate position, and with the pulling over pincers 3 having just released their grip on lasting marginal portions of the upper. Thus the operating stage in accordance with FIG. 5 corresponds to a moment immediately after the operating stage in accordance with FIG. 2 and before the operating stage in accordance with FIG. 3. In this condition the last 10 is supported by the last support 4, which is pressed thereagainst by means of a cylinder 24, and by the heel rest 5 of the pulling over assembly 2, which rest is pressed against the heel of the last 10 by means of a cylinder 26. The cylinder 26 is constructionally integral with the cylinder 24. In addition, the heel rest 19 of the lasting assembly engages the heel end of the last 10 so that, once the shoe upper 9 has been wiped over and the heel end of the last 10 is held by means of the heel rest 19, the last support 4 and heel rest 5 can be retracted from the wiped-over shoe upper 9. This takes place by appropriate actuation of the cylinders 24 and 26. With the release of the last 10 by the heel rest 5 and the last support 4 the pulling over assembly 2 can be moved from the second station to the first station (see FIGS. 2 and 3).

The movement of the pulling over assembly 2 between the stations I, II takes place in a correspondingly lower position of said assembly 2. The constructional unit consisting of the cylinders 24 and 26 is mounted on a base plate 27, which in turn is carried by a piston rod 28 of a cylinder 29, itself secured on the slide 7 which is mounted for movement on the guide rails 8. The cylinder 29 is effective, when the pulling over assembly 2 has moved to the second station, to cause the pulling over assembly 2 together with its pulled-over shoe to be raised into an operative position in which the wiper plate assembly 14 can effect the lasting operation. For supporting the shoe and for pressing the insole 25 against the last 10 after lowering of the last support 4 from the position shown in FIG. 5, an auxiliary toe support in the form of a pressure plate 30 is provided which is advanced and engages the insole 25 (see FIG. 6). For effecting such movement, two cylinders 31, 32 are provided of which the cylinder 32 is effective, via an arm 33 mounted on pivot axis 34, to cause pivotal movement (shown in FIG. 6) of the pressure plate 30 as it is advanced by operation of the cylinder 31, which is mounted on the arm 33. In FIG. 5 is also shown the holddown 15 which, as described with reference to FIG. 1, is mounted for pivotal movement about axis 16 under control of the cylinder 17. The axis 16 is journalled on a bearing block 35, which in turn is secured to a plate 36. The plate 36 rests on two supports 38 arranged on a carrier plate 37. The wiper plate assembly 14 is arranged between the plate 36 and carier plate 37.

In FIG. 6 is shown the apparatus in accordance with FIG. 5, wherein however the pulling over assembly 2 is now shown, since, as already explained with reference to FIG. 3, it has already returned to the first station. From FIG. 6 can be seen how the pressure plate 30 is pivoted from the chain-dot position into the position shown in solid line and engages the insole 25. In this position, in which the last 10 is held also by the heel rest 19, the complete inwiping operation of the lasting wiper assembly 14 now takes place.

For applying adhesive, e.g. a hot melt adhesive, to the insole as mentioned above in the first apparatus in accordance with the invention adhesive nozzles 58 are provided which are guided along the marginal portions of the insole 25. This application takes place after the last support 4 of the pulling over assembly 2 has been lowered from the insole 25 and before the pressure plate 30 moves into engagement therewith. The advancing of the adhesive nozzles 58 against the insole 25 is effected by a cylinder 59, while the movement of the nozzles 58 lengthwise of the insole 25 is effected by a cylinder 60.

Figure 7:
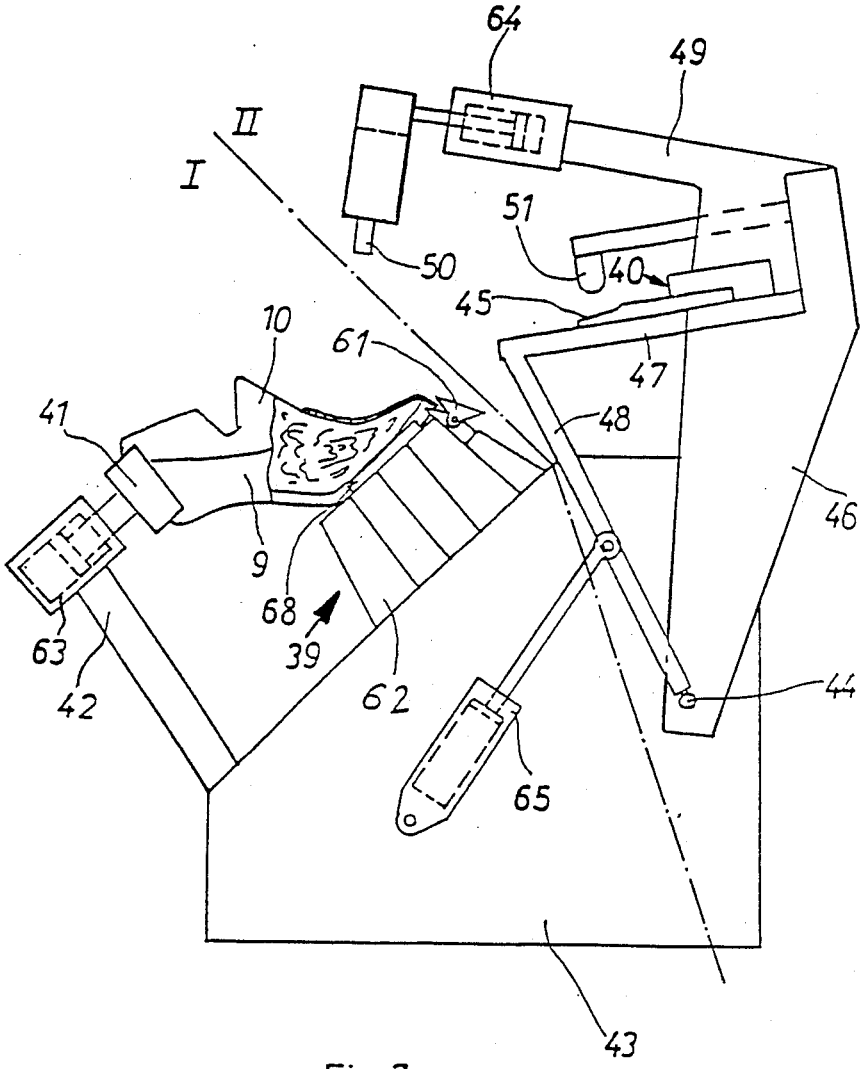
FIGS. 7 to 10 show in side view a second apparatus in accordance with the invention wherein a pulling over assembly thereof is fixedly arranged at a first station and a lasting assembly thereof is mounted for movement between the first station and a second station, the individual Figures showing in detail the following.
Figure 9:
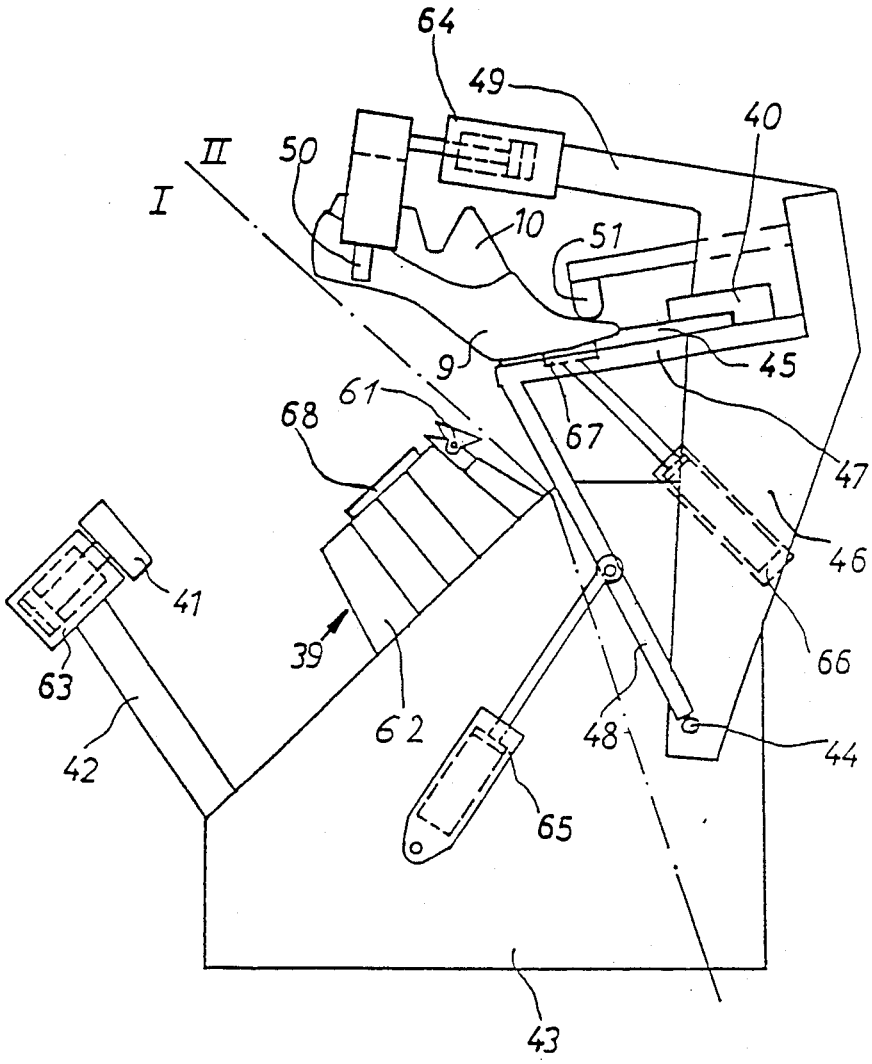
Figure 10:
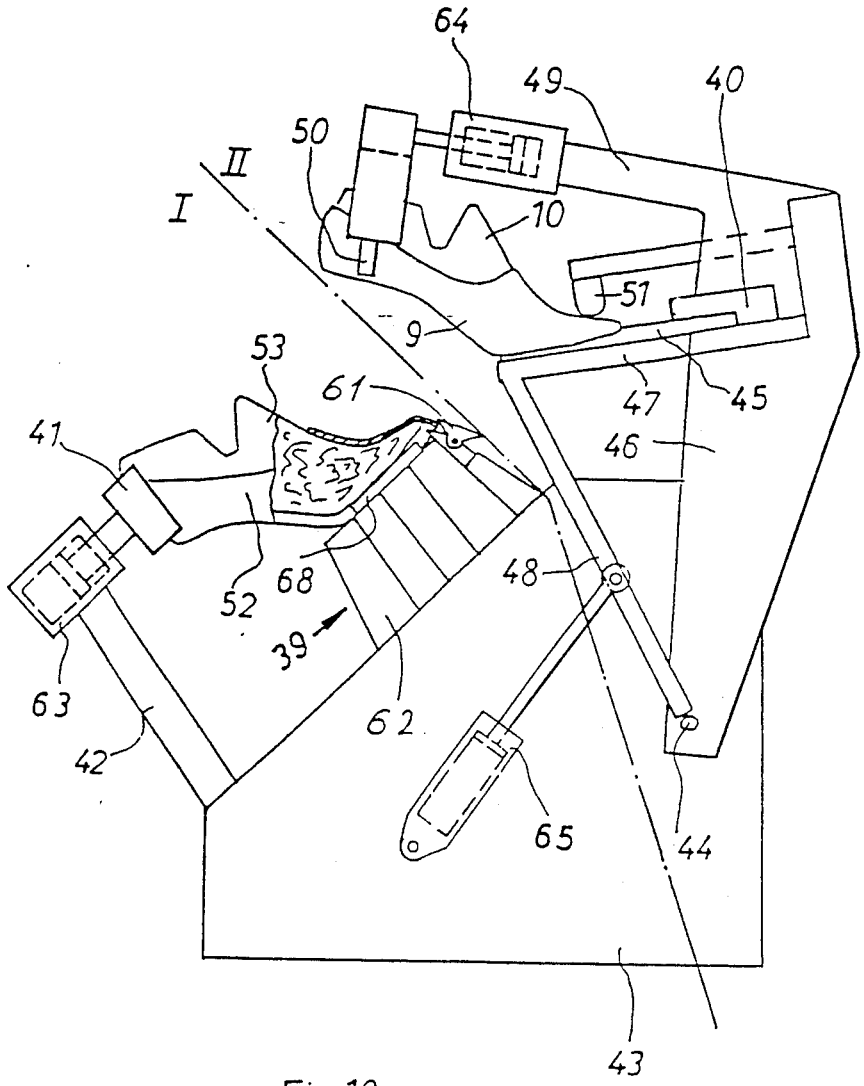

The second apparatus in accordance with the invention is shown in FIGS. 7 and 10. In this case a pulling over assembly 39 is fixedly mounted at a first station I and a lasting assembly 40 is mounted for movement between the first station and a second station II. In these Figures the two stations are separated from one another by a chain-dot line. For reasons of clarity of the illustration, one pulling over pincer 61 of the pulling over assembly 39 is drawn in FIGS. 7, 9 and 10, other pulling over pincers 62 being drawn as blocks.

In accordance with FIG. 7 the shoe upper 9 with its last 10 is inserted in the pulling over assembly 39, the last 10 being held at the heel end thereof by means of a heel rest 41. The heel rest 41 is secured to a carrier 42 via a cylinder 63, the carrier being mounted in turn on a main frame 43. On the main frame 43 is further arranged for pivotal movement about an axis 44 the lasting assembly 40 which can be pivoted from the first station I (see FIG. 7) into the second station II (see FIG. 8). The lasting assembly 40, which comprises a wiper plate assembly 45, is fixed on a pivotal arm 46 and is thus carried by a plate 47 which, for reasons of stability, is additionally supported by a structure 48. Also mounted on the pivotal arm 46 via an extension 49 is a further heel rest 50, which, by means of a counter-abutment (not shown), clamps the heel end of the last 10 from the sides and thus holds it together with the shoe upper 9 (see FIG. 8). The heel rest 50 is set by means of a cylinder 64 to the appropriate size of the shoe being treated.

In addition, mounted on the pivotal arm 46 is a toe pad 51 which is operated in a corresponding manner to the toe pad 54 shown in FIGS. 1 to 6. In accordance with FIG. 7 the shoe upper 9 is pulled over at the first station by means of the pulling over assembly 39, being supported by a last supported 68, while the lasting assembly 40 is disposed at the second station. After the pulling over operation is completed, the lasting operation can now continue, to which end the pivotal arm 46 together with the lasting assembly 40 is pivoted in a direction towards the pulling over assembly 39 from the second station into the first station. A cylinder 65 serves this purpose.

Figure 8:
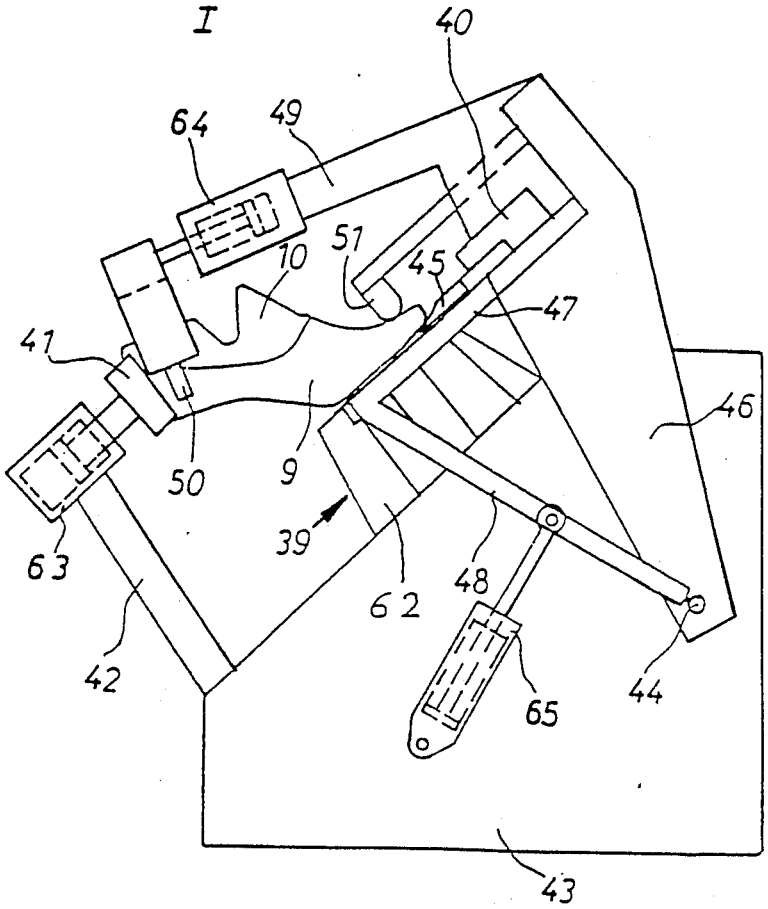

In FIG. 8 the machine is shown with the lasting assembly 40 pivoted into the first station, whereby the pulling over assembly 39 and the lasting assembly 40 are brought into opposed relationship with one another at the first station. In this way the heel support 50 embraces the last 10 from both sides of the heel end while the heel rest 41 of the pulling over assembly (which may in this case be a conventional heel rest commonly used in pulling over and lasting machines) is still in operative engagement with the shoe. In this way the last 10 and shoe upper 9 may be securely held against lengthwise displacement. Then follows the inwiping of the wiper plate assembly 44 to its intermediate position wherein lasting marginal portions of the shoe upper 9 are trapped by the wiper plate assembly 45 against the insole 25. Control of the shoe upper 9 is thus taken over by the wiper plate assembly 45. During the transfer of control the pincers are caused to release the upper in a conventional manner, while at the end of such transfer the heel rest 41 can be withdrawn.

After reaching this operating stage the pivotal arm 46 is pivoted back into the position shown in FIG. 7, returning the lasting assembly to the second station II and therewith the shoe. This is shown in FIG. 9. In the following operating stage the completion of the lasting operation now takes place, by completion of the inwiping movement of the wiper plate assembly. Meanwhile the pulling over assembly 39 is available for the insertion of a new shoe. Where the lasting operation is to be effected using adhesive, e.g. a hot melt, application thereof takes place in a similar manner to that illustrated in FIG. 6. During inwiping movement of the lasting wiper assembly 45 a pressure plate 67, which is advanced by means of a cylinder 66, serves as a conventional toe support.

In FIG. 10 is shown how the shoe upper 9 is finally lasted by means of the lasting wiper assembly 45, while a new shoe upper 52 with last 53 is already inserted into the pulling over assembly and is pulled over. The finished lasted shoe can then be removed from the second station whereupon the further operations, as above described, take place. For the rest, attention is drawn the corresponding explanations to FIGS. 1 to 6.

We claim:

1. Apparatus for pulling over and lasting shoes comprising a pulling over assembly arranged at a first station and comprising a shoe support for supporting a shoe, comprising a shoe upper on a last with an insole on the last bottom, and an array of pincers arranged about the shoe support, whereby the upper of a shoe supported by the shoe support can be gripped by the pincers and, by relative movement being effected between the pincers and shoe support heightwise of the shoe bottom, can be tensioned about its last, a lasting assembly arranged at a second station and comprising a pair of wiper plates by which lasting marginal portions of a shoe upper tensioned as aforesaid can be wiped over and pressed against corresponding marginal portions of the insole of such shoe, and means for effecting relative movement of approach between the pulling over assembly and the lasting assembly to bring the assemblies into a cooperative relationship, in which a shoe upper tensioned as aforesaid is released by the pulling over assembly and control thereof is transferred to the lasting assembly without loss of tension in the upper, and for effecting relative movement of separation therebetween, whereby the lasting operation can be completed at the second station while a further pulling over operation can be initiated at the first station, wherein the pulling over assembly and the lasting assembly each comprises shoe retaining means for holding a shoe supported thereby against lengthwise displacement respectively in the pulling over and lasting operations whereby each assembly can perform its function independently of the other, and further wherein said means for effecting relative movement between the assemblies is effective to move them into said cooperative relationship only after a shoe upper has been tensioned as aforesaid by the pulling over assembly and a previously treated shoe has been released by the lasting assembly.

2. Apparatus according to claim 1 wherein one of the assemblies is fixed at its station and the other is movable between the stations.

3. Apparatus according to claim 1 wherein the pulling over assembly is mounted for movement between the first and second stations.

4. Apparatus according to claim 3 wherein the direction of movement of the pulling over assembly extends transversely of the shoe supported thereby.

5. Apparatus according to claim 1 wherein the lasting assembly is mounted for movement between the first and second stations.

6. Apparatus according to claim 5 wherein the direction of movement of the lasting assembly extends lengthwise of the shoe supported thereby.

7. Apparatus according to claim 1 wherein the shoe retaining means of one of said assemblies is constituted by a shoe clamp arrangement by which the shoe can be clamped by engagement at opposite sides thereof adjacent the heel end and the shoe retaining means of the other of said assemblies is constituted by a heel rest in the form of a pad by which the backseam region of the shoe is engaged.

8. Apparatus according to claim 1 wherein the lasting assembly also comprises a shoe support for supporting the shoe at the second station.

9. Apparatus according to claim 1 wherein the lasting assembly comprises a toe pad by which a shoe which has been operated upon at the first station is engaged when the assemblies are moved to their cooperative relationship.

10. Apparatus according to claim 1 wherein while the two assemblies are in their cooperative relationship the wiper plates are caused to move inwardly to an intermediate position in which leading edge portions thereof have just traversed the insole edge whereby the lasting marginal portions of the upper are trapped against the insole, the pincers of the pulling over assembly releasing the upper in timed relation with such movement of the wiper plates, and relative movement of separation thereafter taking place between the assemblies while the wiper plates are retained in this condition.

11. Apparatus according to claim 10 wherein the second station has associated therewith adhesive-applying means by which, while the wiper plates remain in said intermediate position, adhesive is applied to marginal portions of the insole of the shoe.

12. Apparatus according to claim 11 wherein the adhesive-applying means comprises two nozzles and means for moving the nozzles along opposite sides of the shoe progressively in a direction from the toe end heelwardly.

13. A method of pulling over and lasting shoes wherein:

(i) with a pulling over assembly positioned at a first station and a lasting assembly at a second station, spaced from the first station, a shoe is loaded into the pulling over assembly and a pulling over operation is effected thereon, (ii) relative movement of approach is thereafter effected between the assemblies to bring them into a cooperative relationship and the shoe, pulled over as aforesaid, is transferred to the lasting assembly while being maintained in a pulled over condition, and (iii) relative movement of separation is then effected between the assemblies to move them out of said cooperative relationship, the lasting of the transferred shoe being completed by the lasting assembly while the pulling over assembly is left free for a further shoe to be loaded into said assembly and a pulling over operation to be effected thereon, in carrying out which method step (i) is effected on such further shoe during the completion of the lasting of the first-mentioned shoe, while initiation of step (ii) is dependent upon completion of such lasting operation having been effected.

* * * * *